US008468723B2

(12) United States Patent
Malka-Harari

(10) Patent No.: US 8,468,723 B2
(45) Date of Patent: Jun. 25, 2013

(54) ADJUSTABLE SHOE

(75) Inventor: Galit Danielle Malka-Harari, Calabasas, CA (US)

(73) Assignee: Tilag Brands, LLC, Sherman Oaks, CA (US)

( * ) Notice: Subject to any disclaimer, the term of this patent is extended or adjusted under 35 U.S.C. 154(b) by 741 days.

(21) Appl. No.: 12/459,746

(22) Filed: Jul. 7, 2009

(65) Prior Publication Data

US 2010/0011621 A1 Jan. 21, 2010

Related U.S. Application Data

(60) Provisional application No. 61/135,585, filed on Jul. 21, 2008.

(51) Int. Cl.

| | |
|---|---|
| ***A43B 3/26*** | (2006.01) |
| ***A43B 3/30*** | (2006.01) |
| ***A43C 11/00*** | (2006.01) |

(52) U.S. Cl.

USPC ..... 36/97; 36/50.1; 36/112

(58) Field of Classification Search

USPC ..... 36/50.1, 51, 90, 97, 100, 102, 112

See application file for complete search history.

(56) References Cited

U.S. PATENT DOCUMENTS

| | | | | |
|---|---|---|---|---|
| D80,809 | S | 3/1930 | Schaffner | |
| 2,391,720 | A * | 12/1945 | Ludwig | 36/97 |
| 2,603,889 | A | 7/1952 | Lahnstein | |
| 2,973,589 | A * | 3/1961 | Rigsby | 36/97 |
| 3,057,085 | A * | 10/1962 | Rigsby | 36/97 |
| 3,057,086 | A | 10/1962 | Rigsby | |
| 3,058,241 | A | 10/1962 | Rigsby | |
| 3,142,911 | A | 8/1964 | Waters | |
| 3,299,543 | A | 1/1967 | Merritt | |
| 3,618,235 | A | 11/1971 | Cary | |
| 3,744,163 | A | 7/1973 | Simister | |
| 3,762,075 | A | 10/1973 | Munschy | |
| 4,136,468 | A * | 1/1979 | Munschy | 36/97 |
| 4,204,345 | A * | 5/1980 | Bradley | 36/97 |

(Continued)

FOREIGN PATENT DOCUMENTS

| | | |
|---|---|---|
| EP | 1616495 | 1/2006 |

OTHER PUBLICATIONS

PCT International Search Report, for PCT/US09/04152, Nov. 10, 2009.

(Continued)

*Primary Examiner* — Jila M Mohandesi
*Assistant Examiner* — Sharon M Prange
(74) *Attorney, Agent, or Firm* — Davidson Berquist Jackson & Gowdey, LLP; Brian Siritzky

(57) ABSTRACT

An expandable and adjustable baby shoe or bootie which can be customized to fit during a baby's first two years. The concept is to allow the baby shoe to be expanded as the baby's foot grows so that a single shoe can be used for babies up to 24 months of age. The shoe has an expansion mechanism which enables the front portion of the shoe to be progressively increased as the baby grows. The rear portion of the shoe also has a fastening mechanism whereby the rear area which surrounds the ankles can also be adjusted as the baby grows for a customized fit. The present invention can also be incorporated into a children's slipper as well as a baby shoe.

25 Claims, 7 Drawing Sheets

U.S. PATENT DOCUMENTS

| | | | | |
|---|---|---|---|---|
| D272,962 | S | 3/1984 | Clarvit | |
| 4,599,811 | A | 7/1986 | Rousseau | |
| 5,570,523 | A | 11/1996 | Lin | |
| 5,659,980 | A | 8/1997 | Lin | |
| 5,682,687 | A * | 11/1997 | Arai | 36/97 |
| 5,699,629 | A | 12/1997 | Munschy | |
| 6,189,239 | B1 * | 2/2001 | Gasparovic et al. | 36/102 |
| D438,972 | S | 3/2001 | Darby | |
| 6,393,734 | B1 | 5/2002 | Ou | |
| 6,832,442 | B2 | 12/2004 | Lewis | |
| 6,848,202 | B2 * | 2/2005 | Berggren | 36/97 |
| 6,988,298 | B2 | 1/2006 | Ternasky et al. | |
| 7,287,294 | B2 | 10/2007 | Miller | |
| 8,146,271 | B2 * | 4/2012 | Friton | 36/50.1 |
| 2002/0178616 | A1 * | 12/2002 | Williams | 36/97 |
| 2006/0005432 | A1 * | 1/2006 | Kassai et al. | 36/138 |
| 2009/0272010 | A1 * | 11/2009 | Loverin | 36/112 |

OTHER PUBLICATIONS

Written Opinion of the International Searching Authority, Nov. 10, 2009, in PCT/US09/04152.

* cited by examiner

ADJUSTABLE SHOE

This application claims the benefit of U.S. Provisional Application No. 61/135,585, filed Jul. 21, 2008.

BACKGROUND OF THE INVENTION

1. Field of the Invention

This invention relates to baby shoes. More particularly, the present invention relates to an expandable and adjustable foot covering for babies that may be worn easily and comfortably allowing for healthy foot development. This expandable shoe and/or bootie allows for a customized fit during a baby's first two years. The concept of this unique idea allows the shoe the ability to "grow" and/or "expand" with the growth of the foot from 0-24 months.

2. Description of the Prior Art

The following 17 patents are relevant to the field of the present invention.

1. U.S. Design Pat. No. Des. 80,809 issued to Karl Schaffner on Mar. 25, 1930 for "Baby's Shoe" (hereafter the "Schaffner Design Patent");

2. U.S. Pat. No. 2,603,889 issued to Evelyn K. Lahnstein and Joseph Albert Lahnstein on Jul. 22, 1952 for "Shoe" (hereafter the "Lahnstein Patent");

3. U.S. Pat. No. 3,058,241 issued to Rowena N. Rigsby on Oct. 16, 1962 for "Expandible Shoe" (hereafter the "'241 Rigsby Patent");

4. U.S. Pat. No. 3,057,086 issued to Rowena N. Rigsby on Oct. 9, 1962 for "Expandible Shoe" (hereafter the "'086 Rigsby Patent");

5. U.S. Pat. No. 3,142,911 issued to Harry F. Waters on Aug. 4, 1964 for "Adjustable Child's Shoe" (hereafter the "Waters Patent");

6. U.S. Pat. No. 3,618,235 issued to George R. Cary, Jr. on Nov. 9, 1971 for "Adjustable Footwear" (hereafter the "Cary Patent");

7. U.S. Pat. No. 3,744,163 issued to Louis W. Simister on Jul. 10, 1973 for "Baby Expansion-Slipper" (hereafter the "Simister Patent");

8. U.S. Pat. No. 3,762,075 issued to Dorothy G. Munschy on Oct. 2, 1973 for "Disposable Shoe" (hereafter the "Munschy Patent");

9. U.S. Design Pat. No. Des. 272,962 issued to Richard N. Clarvit on Mar. 13, 1984 for "Baby Shoe" (hereafter the "Clarvit Patent");

10. U.S. Pat. No. 4,599,811 issued to Jean L. Rousseau on Jul. 15, 1986 for "Easy To Put On Wrap-Around Shoe Which Is Adaptable To The Shape Of the Foot" (hereafter the "Rousseau Patent");

11. U.S. Pat. No. 5,570,523 issued to Ji-Tyan Lin on Nov. 5, 1996 for "Adjustable Child Shoes" (hereafter the "'523 Lin Patent");

12. U.S. Pat. No. 5,659,980 issued to Ji-Tyan Lin on Aug. 26, 1997 for "Adjustable Shoe" (hereafter the "Lin Patent");

13. U.S. Design Pat. No. D438,972 issued to H. Darnell Darby and assigned to Darco International, Inc. on Mar. 13, 2001 for "Surgical Shoe" (hereafter the "Darby Design Patent");

14. U.S. Pat. No. 6,393,734 issued to Chan-Chou Ou on May 28, 2002 for "Adjustable And Disposable Foot Care Article" (hereafter the "Ou Patent");

15. U.S. Pat. No. 6,832,442 issued to Patricia Lewis et al. and assigned to Morning Pride Manufacturing, L.L.C. on Dec. 21, 2004 for "Adjustable Sizable And Protective Boot" (hereafter the "Lewis Patent");

16. U.S. Pat. No. 7,287,294 issued to Harry Miller et al. and assigned to Harry Miller Co., Inc. on Oct. 30, 2007 for "Method of Making An Expandable Shoe" (hereafter the "Miller Patent");

17. European Patent Application No. EP 1,616,495 issued to Aprica Kassai on Jan. 18, 2006 for "Shoe" (hereafter the "Kassai European Patent Application").

The Schaffner Patent is a design patent which discloses the concept of having strap members along the back with a flexible band member at the end of the side strap.

The Lahnstein Patent discloses the broad concept of having a shoe wherein the length and width of the shoe may be adjusted as a child's foot grows so that the shoe at no time will bind or otherwise be uncomfortable for the child. The width of the shoe can be adjusted by having mating members 14 and 13 on one side of the shoe fixed respectively to different locations on mating members 16 or 17 so that the tightness of the shoe can be contracted for a smaller foot and expanded for a larger foot. Also, the front of the shoe 12 can be mated with member 14. The length of the shoe can also be adjusted by having mating member 12 where the length can be adjusted.

The '241 Rigsby Patent embodies within it the concept of having a baby shoe that is adapted to be enlarged to compensate for the growth of an infant's foot. The shoe essentially consists of a front section 46 with a multiplicity of different eyelets so that as the shoe lace is expanded through the eyelets, the length of the shoe can either be increased or decreased depending upon which series of eyelets are engaged with the shoelace.

In the '086 Rigsby Patent the length is adjusted by having different eyelets so that a shoelace can be threaded through different eyelets to increase or decrease the length of the shoe.

The Waters Patent embodies the concept of having an adjustable child's shoe so that the size of the shoe can be increased as the child grows. The adjustment is made on the rear by having an interlocking weaving pattern of a shoelace with a pleated member as best shown in FIG. 3 so that the width of the back can be adjusted to be smaller or larger.

The Cary Patent is for adjustable footwear and is intended as an adult orthopedic shoe wherein the shoe has a toe covering which includes sections that are laterally adjustable and easily fixed in any given position of adjustment. The toe covering is split along a midline of the shoe to form two lateral sections that can be adjusted towards and away from the shoe midline and tongue like element is secured to the forward portion of the shoe to overlap the two lateral covering sections and to maintain the sections in the desired adjusted position. Therefore, infinite adjustment is available through the use of the mating velcro sections. The idea however is to adjust the front width of the shoe to accommodate a specific width of a person so that the shoe can be wider or narrower with the velcro members 34 being spaced further apart or closer together and then joined by the mating velcro member 36.

The Simister Patent is a baby expansion slipper wherein the length of the shoe can be adjusted by having a mating snap member 6' either go to snap member **6*d* or 6*b*'** and the length is thereby adjusted depending upon which snap member-is engaged.

The Munschy Patent discloses a disposable shoe where there are various fold lines as best illustrated in FIG. 3 so that the overall length of the shoe can be adjusted and then closure members on the left or right to mateably close the back end of the shoe with a velcro fastener. The invention is intended as a disposable shoe wherein the length of the shoe can be adjusted by folding over the specific length at the rear of the shoe and then closing behind it.

The Clarvit Patent is a design patent application for a baby shoe. Essentially the width of the shoe can be adjusted by having mating Velcro® fasteners as three members as indicated in the figures so that the overall width of the front of the shoe can be adjusted depending upon how tightly the Velcro® strap members are engaged.

The Rousseau Patent has a detailed disclosure of how to adjust the sides of a shoe. Specifically, the invention discloses the concept of having an adjustable shoe where the rear width of the shoe and the length and width of the shoe can be adjusted by various mating velcro members on different portions of the shoe.

The '523 Lin Patent discloses an adjustable child's shoe which discloses a plurality of different fastening members on the toe and the heel to adjust the length of the shoe.

The '980 Lin Patent is an adjustable shoe which contains additional features such as having the rear adjusted as best illustrated in FIGS. 2 and 1 to have different widths depending upon the engagement of snap members on the rear.

The Darby Patent is a design patent which protects the shape of the product. This patent is for a surgical shoe wherein there is a flap on the top of the shoe that adjusts the overall width of the front portion of the shoe and a band and strap that adjusts how tight the top of the shoe is over the person's upper foot area.

The Ou Patent discloses an adjustable and disposable foot care article with an adjustable rear fastening member as best show in FIG. 3 so that the rear width of the shoe can be adjusted depending upon the width of the person's ankle. There are also a multiplicity of side adjustment members as illustrated in FIGS. 1 and 6 wherein the overall width of the shoe can be adjusted.

The Lewis Patent is an adjustable sizable protective boot. The overall length of the shoe can be adjusted by the front flap 18 and its mating velcro member being affixed along any location along the mating velcro members 30 along the front portion of the shoe. In addition, there is a band so that the overall width of the shoe at the location around the base of the foot as well as the upper portion of the foot can be adjusted in terms of width.

The Miller Patent discloses a method of making an expandable shoe which involves:

> "A method of making an expandable shoe is disclosed. An intermediate footwear structure is provided having an expandable upper portion. A stabilizing material is provided to the intermediate structure to resist expansion of the upper portion, and a last is inserted into the intermediate structure. A subsequent manufacturing operation is performed to the intermediate structure, and the stabilizing material is acted upon to permit longitudinal movement of the upper portion. The size of the last is selected from among the sizes within the intended range of shoe sizes for the expandable shoe, depending on the characteristics of the upper portion of the shoe, and the desired shoe size range."

The European Patent Application which was published in 2006 discloses: "A shoe 10 which comprises a sole 11 and an upper positioned above the sole and having a height so as to cover up to an ankle. The upper comprises a lower upper 12 including a tongue for covering an instep, right and left side parts 14*a*, 14*b* having a height so as to cover an anklebone and gradually reduced in height backward, and a rear part 17 which connects the right and left side of parts 14*a*, 14*b*, and a higher upper 20 having a height so as to cover the ankle from a position in which an upper region of the lower upper is overlapped, one end connected to the right side part 14*a* of the lower upper 12, a middle region partially and sequentially overlapping with the right side part 14*a*, the rear part 17 and the left side part 14*b* of the lower upper 12, and a fixing part 27 connected to the left side part 14*b* and detachably connected to a hook and loop fastener 34 of the higher upper 20."

SUMMARY OF THE INVENTION

The present invention relates to expandable and adjustable baby shoes or booties which can be customized during a baby's first two (2) years. The concept allows the shoe the ability to be expanded as the baby's foot grows so that a single shoe can be used for a baby up to 24 months of age. Also, since the ankles of boys' and girls' feet are different, there is an ankle variation expansion member in the back as will be discussed that enables the width of the back of the shoe to be adjusted.

In an initial concept of the invention as discussed in the provisional patent application, and improved upon as set forth in this full patent application. The invention works by simply pulling on an elastic strap connected to a fastener member which can be attached to the shoe by infinitely variable and hook and loop attachment mechanism so that the length of the shoe can be reduced and expanded. A separate ankle adjustment mechanism with an infinitely variable attachment mechanism enables the shoe to accommodate variations in ankle sizes for boys and girls and to accommodate ankle growth as the infant grows.

It is an object of the present invention to provide an infant shoe including, but not limited to, unisex designs which can be used by infant boys and infant girls, with adjustment mechanisms which can vary the length of the shoe and vary the interior size of the shoe at the ankle area. The present invention is an improvement over prior art variable infant shoes in that the length is quickly adjusted to any desired length within a given range by mating hook and loop fasteners which can be connected at a multiplicity of connection locations to precisely achieve a desired length. The ankle area of the shoe can also be quickly adjusted to any desired size within a given range by mating hook and loop fasteners which can be connected at a multiplicity of connection locations to precisely achieve a desired ankle size for the shoe. The mechanism is also protected so that it will not come loose while the infant is active.

It is a further object of the present invention to provide an expandable and adjustable baby shoe for infants from 0 months up to 24 months of age with each of the shoes in the pair of shoes having adjustment mechanisms to accommodate growth of the foot and to accommodate differences in the size of the foot in an infant.

It is also an object of the present invention to provide an infant shoe made of flexible but strong material such as leather, suede and other strong flexible material which can be compressed and expanded and endure wear and tear.

The shoe can expand from its full length of approximately 5 inches and retract to its smaller length of approximately 3.25 to 4 inches. The method by which this unique concept works is by adding in a total of 1 to 1½ extra inches of fabric where when the shoe is at its smallest size, the fabric is "squeezed" throughout the top of the foot. In brief, the largest size shoe is designed to fit a 24-month-old child, and an adjustment of the extra fabric is made from the top so that it "shrinks", thus converting the size back to its infant size. The principle discussed here for a baby shoe can also be incorporated into a slipper worn by both children and adults.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
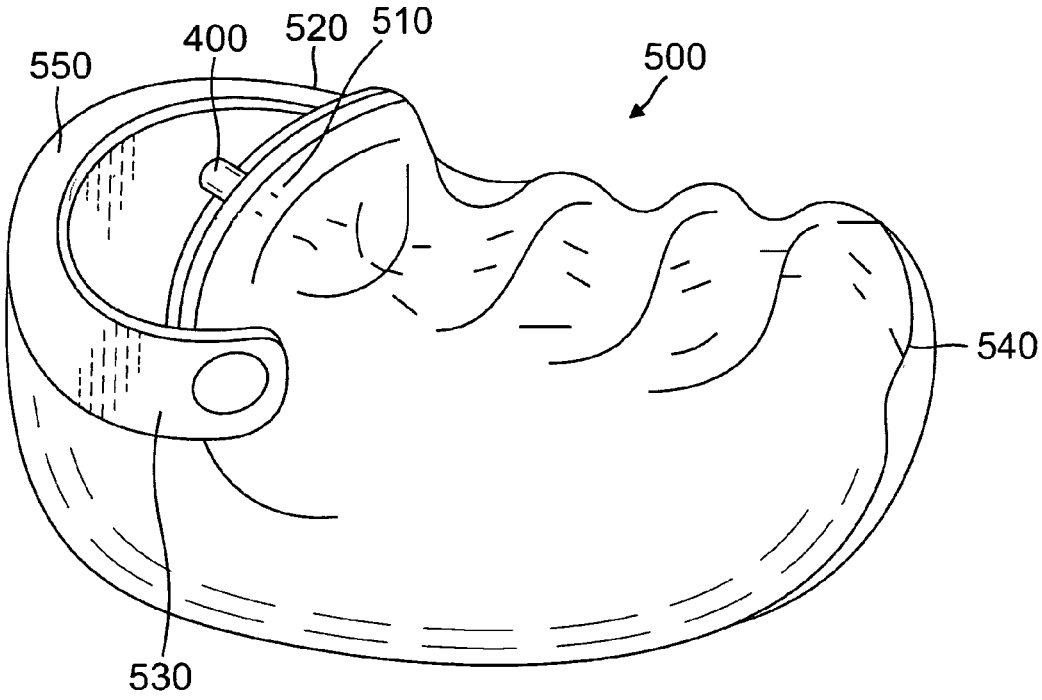
FIG. 1 is a side perspective view of a preliminary embodiment of the present invention shoe desorbed in the provisional application.
Figure 2:
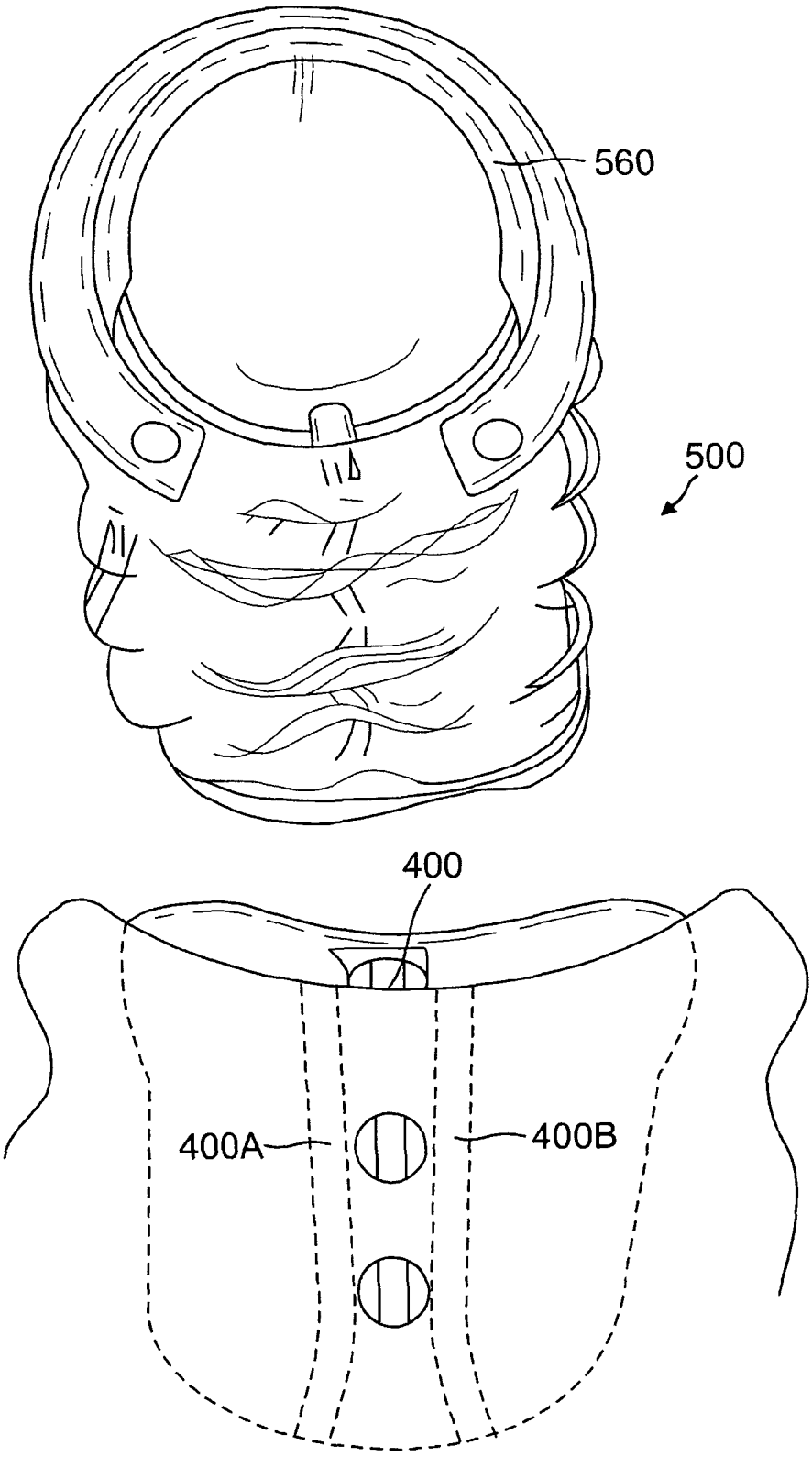
FIG. 2 is an exploded view showing the first embodiment of stretchable shoes according to the present invention from FIG. 1, with the shoe in its most compressed condition.
Figure 3:
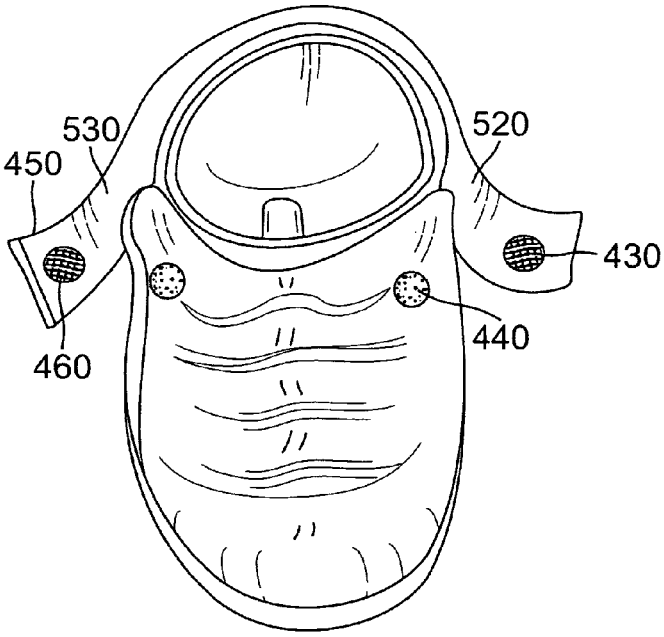
FIG. 3 is a top plan view of the first embodiment from FIG. 1, with the shoe in a more expanded condition, with the fasteners around the ankle area in the open condition.
Figure 4:
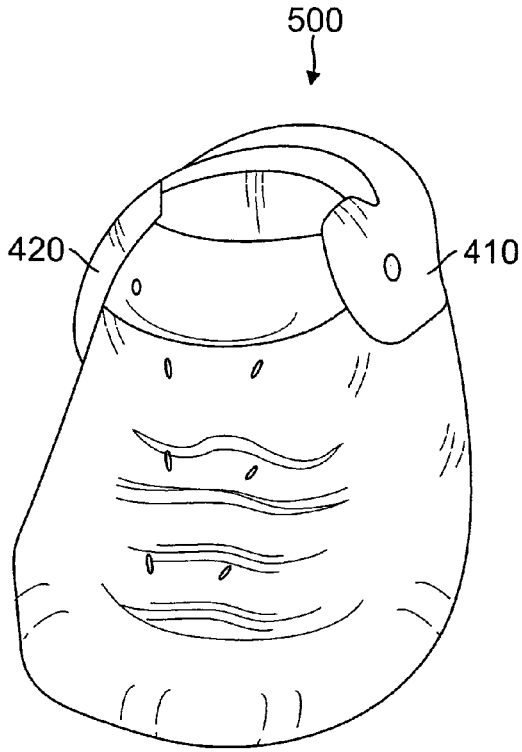
FIG. 4 is a top plan view of the first embodiment from FIG. 1, with the shoe in a more expanded condition, with the fasteners around the ankle area in the closed condition.

FIGS. 1 through 4 disclose an initial concept for the present invention as presented in the provisional patent application. An elastic loop 400 in the shape of a U is securely sewn and properly lined on the top center front 510 of shoe 500 from the front toes area 540 and back up to the center of the foot area 510. When the elastic 400 is pulled back or opposite from toes area 540 of the shoe 500, it pushes the fabric inward, thus shortening the length of shoe 500 as illustrated in FIG. 2. When the elastic 400 is released, the length of the shoe expands as illustrated in FIGS. 1 and 4. Furthermore, the closure members 520 and 530 wrap around the ankle area 520 and are attached with adjustable mating hook and loop mating members 430, 440, 450 and 460. This allows for a proper fit around the ankle eliminating the possibility of shoe being too loose or too tight and furthermore allowing the foot to slide in and out easily. Said invention may be constructed, but is not limited to, three pieces of flexible, solid material such as leather, suede and soft fabric that will stretch from the top center of the shoe by pulling toward the front of the shoe until the desired size is achieved. The non-skid sole of this expandable shoe allows the child to feel the ground both indoors and outdoors, allowing a secure grip and promoting natural muscle development for healthy foot development as well as keeping the child's feet dry in summer and warm in winter. This unique concept allows the user to expand the length of the shoe with simplicity and ease. The length of the shoe is easily adjusted by gently pulling on the U-shaped elastic strands 400, 400A and 400B that are securely sewn on top of the shoe from the center of toe 540 to the center of the foot area 510. Additionally, the use of elastic 560 around the ankle and hook and loop fasteners on each side of the foot will allow for a customized fit. The concept of expanding the length of the shoe will save money on purchasing new shoes every few months. With existing shoes, it is necessary to purchase a new shoe every few months. With the expandable shoe, you get three to four pairs of shoes for the price of one. Since the average baby begins to walk at approximately 12 months of age, wear and tear will be minimal, allowing the same shoe to be used for up to 24 months.

The basic concept of the invention as disclosed in the provisional patent application and in FIGS. 1 through 4 has been improved upon by the inventor based on experimental use and trial and error to arrive at a significantly improved embodiment of the invention as disclosed in FIGS. 5 through 12.

Referring to FIGS. 5 through 11, the baby shoe or bootie 10 has a body 12 having a top section 14, a sole 60 and a pair of oppositely disposed side section walls 62 and 64 which extend to a rear section wall 66. The baby shoe 10 has a toe area 16 adjacent its front 18 and an ankle area 20. The top section 14 has an upper or outer surface layer 22 and an interior layer 24. The upper surface 22 and interior layer have a multiplicity of slits or openings extending through the upper surface layer 22 and extending through the interior layer 24. By way of example, there can be three openings 26, 28, and 30 as illustrated. It will be appreciated that it is within the spirit and scope of the present invention to have any desired multiplicity of slits or openings. The slits facilitate the length of the shoe 10 being compressed by the flexible strap member as discussed below.

Sewn into the interior of the front 18 of the baby shoe 10 at a location adjacent the toe area 16 is a flexible elastic strap member 40 which extends within the interior of the body 12 between the interior layer 24 and the outer surface layer 22 of the top section 14 and is visible from the openings 26, 28 and 30. The flexible elastic strap member 40 extends out of an opening 32 between the interior layer 24 and outer surface layer 22 located adjacent the interior rim 34 of the top section 14. The flexible elastic strap member 40 terminates in a mating fastening member 42 having an upper surface 44 and lower surface 46 which includes a surface of mating fastening members 48 such as a hook or loop fastener. On the outer surface layer 22 of the top section 14 of the baby shoe 10 at a location adjacent the opening 32 is mating fastener member 50 such as a hook or loop fastener. The fasteners 48 and 50 are mating fasteners so if one of the fasteners is a hook fastener, then the other fastener is a mating loop fastener.

One key innovation of the present invention is the combination of the flexile elastic strap member 40 which extends through the interior of the bootie or baby shoe 10 between the interior layer 24 and the outer surface layer 22 which is visible through the openings or slits 26, 28 and 30. The top 14, sole 60 and sidewalls 62 and 64 of the body 12 are made of soft flexible material and the openings 26, 28 and 30 further enable the top 14, sole 60 and sidewalls 62 and 64 to be compressed as the flexible elastic strap 40 is pulled so that the mating fasteners 48 and 50 can be joined at any multiplicity of locations to decrease the length of the front of the baby shoe 10 or increase the length if the baby shoe 10 is in its most compressed configuration. The top 14, sole 60 and sidewalls 62 and 64 form a first interior space 10A which is also reduced as the shoe 10 is compressed. Although it is within the spirit and scope of the present invention to have an outer surface layer 22 without openings 26, 28 and 30, the openings facilitate the compression of the baby shoe 10 to its smallest and smaller lengths.

Figure 5:
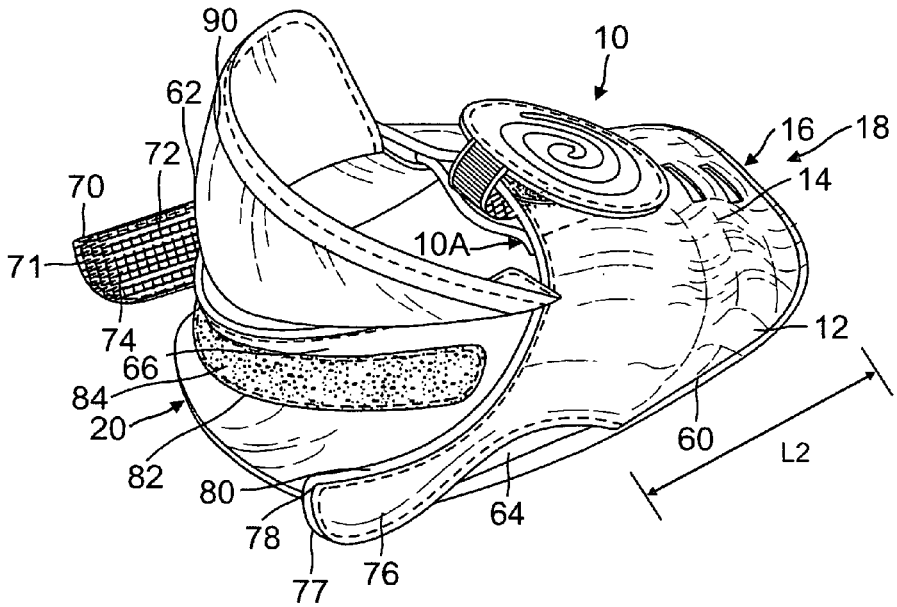
FIG. 5 is a rear perspective view of the preferred embodiment of the present invention expandable and adjustable baby shoe with the front closure member in the closed position and the shoe minimally compressed in the lengthwise direction and the rear closure members in the opened condition.
Figure 6:
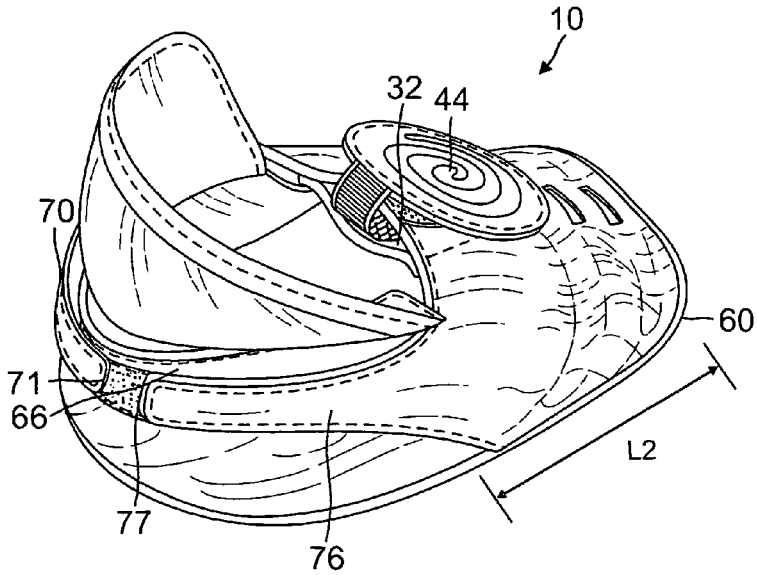
FIG. 6 is a rear perspective view of the preferred embodiment of the present invention expandable and adjustable baby shoe with the front closure member in the closed position and the shoe minimally compressed in the lengthwise direction and the rear closure members in the closed condition with the protective cover flap in the opened condition.
Figure 8:
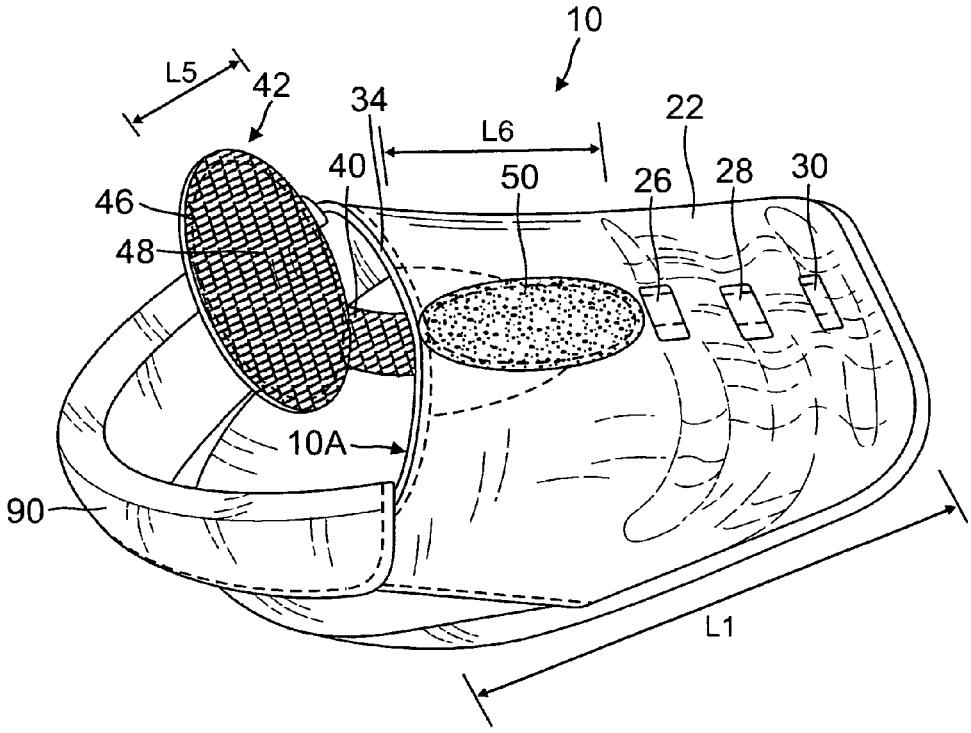
FIG. 8 is a top perspective view of the preferred embodiment of the present invention expandable and adjustable baby shoe with the front closure member in the opened condition and the rear closure members in the closed condition with the protective cover flap in the closed condition.
Figure 9:
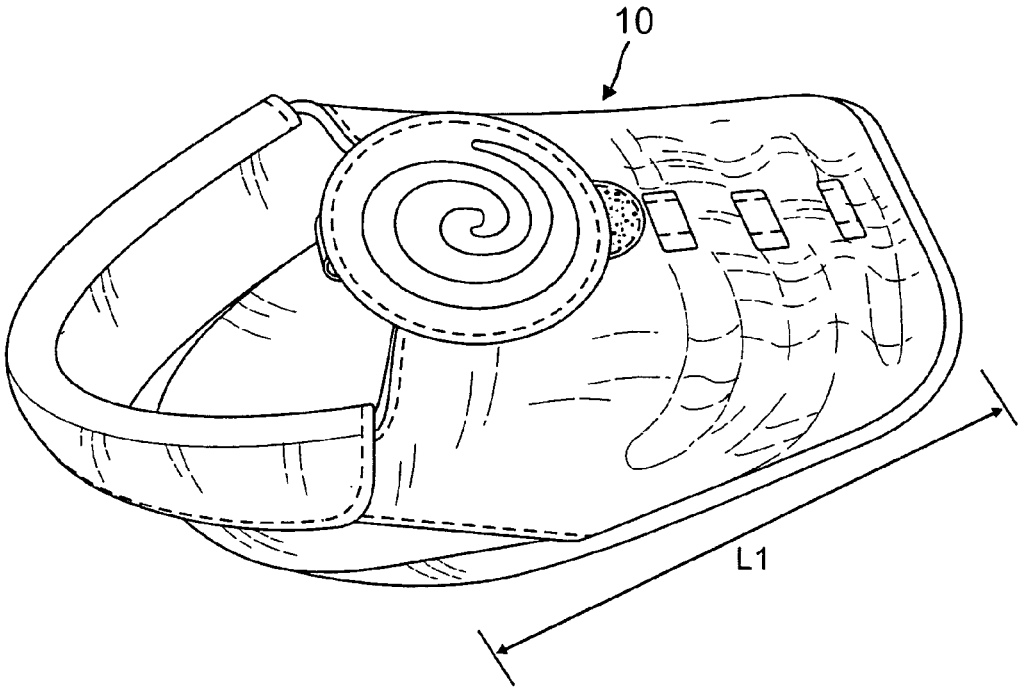
FIG. 9 is a top perspective view of the preferred embodiment of the present invention expandable and adjustable baby shoe with the front closure member in the closed position and the shoe uncompressed in the lengthwise direction and the rear closure members in the closed condition with the protective cover flap in the closed condition.
Figure 10:
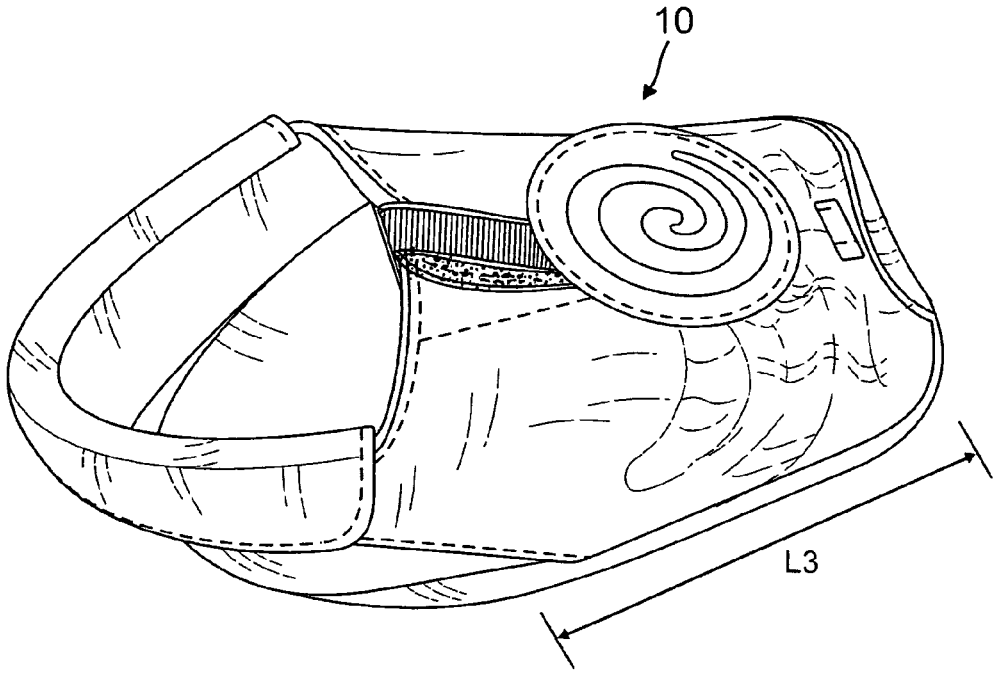
FIG. 10 is a top perspective view of the preferred embodiment of the present invention expandable and adjustable baby shoe with the front closure member in the closed position and the shoe compressed in the lengthwise direction to cover a first slit and the rear closure members in the closed condition with the protective cover flap in the closed condition.
Figure 11:
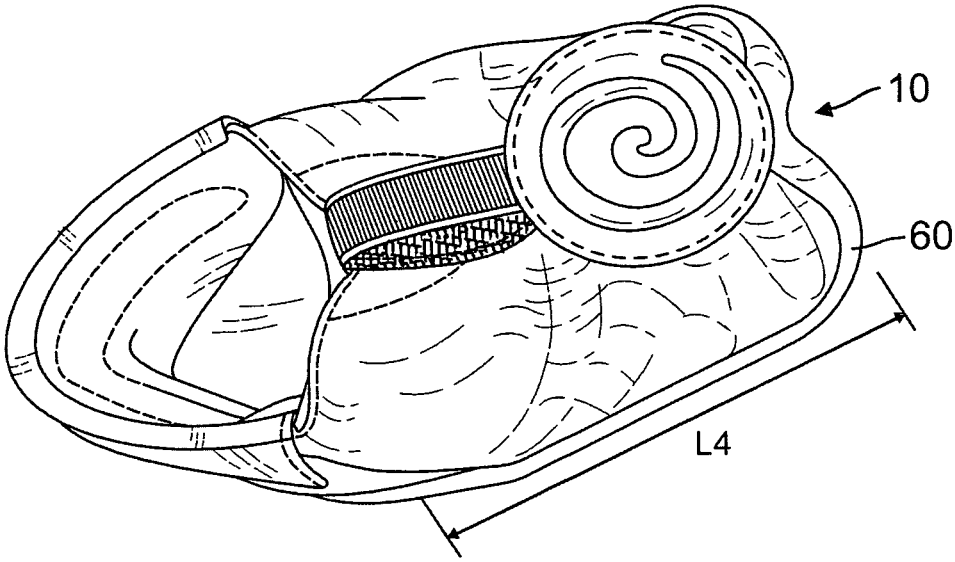
FIG. 11 is a top perspective view of the preferred embodiment of the present invention expandable and adjustable baby shoe with the front closure member in the closed position and the shoe compressed in the lengthwise direction to the maximum extent and the rear closure members in the closed condition with the protective cover flap in the closed condition.

The baby shoe 10 is illustrated in its uncompressed length "L1" in FIGS. 8 and 9. The length "L1" is decreased by pulling on the strap 40 and affixing the mating fasteners 48 and 50 so that toe area 16 is closer to the interior rim 34 and the mating fastening member 42 is closer to the toe area 16. The length "L5" of the interior surface 46 of the fastener member 42 and the length "L6" of the mating fastener 50 on the top outer layer 22 are sufficiently long so that the fasteners 48 and 50 can be affixed at any multiplicity of desired locations to compress the top 14, sole 60 and sidewalls 62 and 64 of the baby shoe 10 by any desired amount. The top 14 and other sections of the baby shoe 10 are compressed by a given amount as illustrated in FIGS. 5 and 6 so that the top slit 26 is concealed and the length of the front is reduced to "L2" . The top 14 and other sections are further compressed by having the top fastener 48 connected to the lower fastener 50 at a location closer to the front 18 so that both the first slit 26 and second slit 28 are concealed as illustrated in FIG. 10 and the length of the front is reduced to "L3" . The top 14 and first interior space 10A are in their most compressed condition by having the top fastener 48 connected to the lower fastener 50 at a location so that the fastener member 42 is closest to the front 18 of the shoe/bootie 10 as illustrated in FIG. 11 and the length of the front is reduced to "L4" . In this condition all three sits 26, 28 and 30 are concealed.

When the infant is at its earliest age when the baby shoe 10 is worn, the baby shoe is in its most compressed condition as illustrated in FIG. 11. As the infant grows and the infant's foot grows, the length of the baby shoe 10 and area of the first interior space 10A are expanded by adjusting the mating fastener 42 so that it is further away from the front 18 and toe area 16. The views in FIGS. 5 through 11 are just three of a multiplicity of locations for the mating fastener 42 relative to the front 16 as the combination hook and loop fastener surfaces 48 and 50 permit any desired compressed length and compressed first interior space 10A for the baby shoe 10 from the top interior rim 34 to the front 16 so that the front length of the baby shoe can be progressively increased as the infant grows from "L4" to "L1" and the first interior space 10A is also progressively increased to accommodate a larger baby foot as the infant grows.

A second key innovative feature of the present invention is the ability to adjust the tightness of the bootie around the infant's ankle area and also over the infant's foot. The top section 14 of the baby shoe/bootie 10 is affixed to a bottom sole section 60. The baby shoe 10 also comprises a pair of oppositely disposed sidewalls 62 and 64 which are affixed to the bottom sole section 60 and extend rearwardly to create a back section wall 66 of the baby shoe 10. The back section wall 66 and a portion of the sidewalls 62 and 64 surround the back and sides of an ankle of an infant when the baby shoe 10 is worn and the top section 14, sidewalls 62 and 64 and sole 60 enclose the infant's foot.

The top section 14 includes a pair of oppositely disposed elongated extension flaps 70 and 76. Extension flap 70 includes an interior surface 72 having a mating fastener 74 which is preferably one of a hook or loop mating fastener. Extension flap 76 includes an interior surface 78 having a mating fastener 80 which is preferably one of a hook or loop mating fastener. The back section 66 includes an exterior sidewall 82 having a mating fastener 84 which preferably is either a hook or a loop fastener. The mating fasteners 74 and 80 are the same and mate with the mating fastener 84. Therefore, if mating fasteners 74 and 80 are hook fasteners, then mating fastener 84 will be a loop fastener. Conversely, if mating fasteners 74 and 80 are loop fasteners, then mating fastener 84 will be a hook fastener. As illustrated in FIGS. 5 through 11, mating fasteners 74 and 80 can be affixed at any multiplicity of selected locations to mating fastener 84. Extension flap 70 terminates at distal end 71. Extension flap 76 terminates at distal end 77. The second interior space 10B which is an area of shoe 10 is surrounded by back section 66, sole 60 and sidewalls 62 and 64 is made smaller as ends 71 and 77 are affixed closer to each other by their respective mating fasteners 74 and 80 to mating fastener 84. Therefore, for an infant with the smallest ankle, the extension flaps 70 and 76 are affixed by their respective mating fasteners 74 and 80 to the mating fastener 84 so that ends 71 and 77 touch each other. To expand second interior space 10B, the baby shoe 10 to accommodate an infant with a larger ankle (either the infant has a lager ankle at its earliest age when wearing the bootie or the infant's ankle size increases as the infant becomes older) the extension flaps 70 and 76 are affixed by their respective mating fasteners 74 and 80 to the mating fastener 84 so that ends 71 and 77 are further away from each other. Through this variable connection method, the second interior space 10B of the baby shoe 10 at the location of the ankle can be gradually increased to accommodate the infant's growth. In addition, the tightness of the baby shoe where the interior 10A of the top section covers the infant's foot can be adjusted. The closer ends 71 and 77 are to each other, the smaller the first interior space 10A of the baby shoe to accommodate an infant's foot when the infant's foot is smallest. As the infant grows, the adjustment of the connection of the extension flaps 70 and 76 to cause the ends 71 and 77 to be further way from each other when the extension flaps 70 and 76 are affixed to the back area 66 of the baby shoe 10 by their respective mating fasteners also results in the top section 14 being further away from the sole 60 so that the baby shoe area 10A can accommodate a larger foot as the infant grows.

Figure 7:
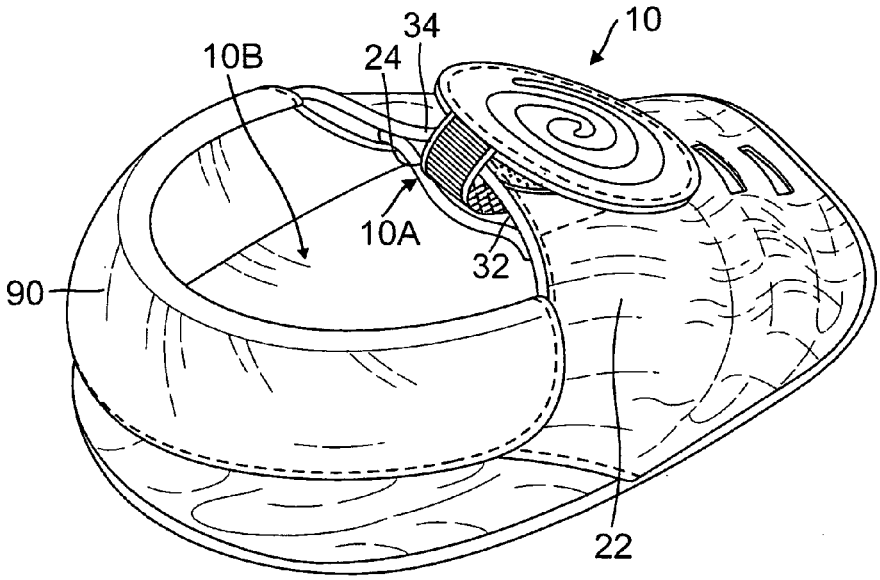
FIG. 7 is a rear perspective view of the preferred embodiment of the present invention expandable and adjustable baby shoe with the front closure member in the closed position and the shoe minimally compressed in the lengthwise direction and the rear closure members in the closed condition with the protective cover flap in the closed condition.

An additional innovation of the present invention is a covering flap 90 attached to the back area wall 66 and sidewalls 62 and 64. The covering flap 90 is preferably attached along a top surface 62A and 64A of the sidewalls 62 and 64 and along the top surface 66A of the back wall 66. The covering flap is illustrated in an open condition in FIGS. 5 and 6. After the connection is made between the extension flaps 70 and 76 and the back wall 66 through their fastening members as discussed above, the covering flap 90 is lowered so that it folds over and covers the extension flaps as illustrated in FIGS. 7 and 8. The covering flap 90 provides more comfort to the infant and also covers the extension flaps 70 and 76 to provide further protection to prevent the connection between the extension flaps 70 and 76 and back wall 66 from coming loose while the infant is walking and playing. The covering flap 90 therefore provides both comfort and additional security for the baby shoe 10, especially in situations where a child's ankle is particularly thick and/or tall.

Figure 12:
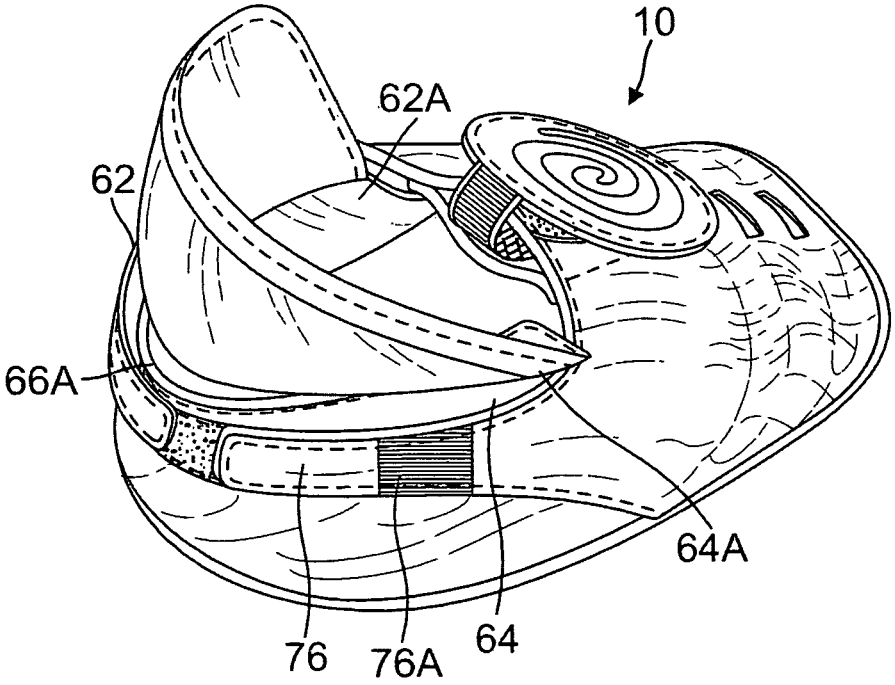
FIG. 12 is a top perspective view of the preferred embodiment of the present invention expandable and adjustable baby shoe with the front closure member in the closed position and the shoe compressed in the lengthwise direction to cover a first slit and the rear closure members in the opened condition illustrating a variation of the rear closure flaps, with the protective cover flap in the opened condition.

The extension flaps 70 and 76 as illustrated in FIGS. 5 through 11 are made of non-expandable material. One additional option is the inclusion of a section of elastic material into the extension or adjustment flaps 70 and 76. As illustrated in FIG. 12, extension or adjustments flap 76 has a section of elastic material 76A permitting the extension flap 76 to have more flexibility to be attached to the back wall 66. Extension or adjustment flap 70 also has a corresponding section of elastic material.

The invention solves the following problems:

- The ability and flexibility to make necessary adjustments in length and width with ease providing appropriate comfort and support for growing feet.
- Eliminating the need to replace shoes every few months within the first two years during the time feet grow the most.
- Giving a customized fit for all types of feet (wide and narrow) with ease by putting on and removing shoes,
- Saving time and money on shopping for replacement baby shoes.
- Convenience in making proper adjustments when one foot is larger than the other.

This invention is different from any existing and/or patented expandable and adjustable shoe. The only other company to manufacture an expandable shoe is called Inchworm. It offers expandable tennis shoes designed for children 4 years old through adults, and not designed for infants or toddlers. Inchworm shoes grow in half size increments by pushing a button on the side, and pulling the toe of the shoe to adjust into the next size. The materials used to manufacture tennis shoes are typically hard and sturdy material suitable to withstand wear and tear.

The present invention does not have any mechanical buttons, but simply an elastic strap member 40 by which the front length of the baby shoe 10 can be adjusted as discussed above. By way of example, the shoe can expand from a compressed length of approximately 3.25 to 4 inches to a fully expanded length of approximately 5 inches. Through this innovation, the length of the baby shoe 10 can be expanded as the foot of the infant grows.

With the present invention, there is no longer a need to leave a gap too large or too tight between the toes and no more need to constantly replace the shoe or bootie for a comfortable and protective fit. The present invention expandable and adjustable shoe will be available in a variety of fabrics such as soft leather/suede and other soft fabrics, and will be available in an ever-increasing color selection.

It has been documented that during baby's first years, soft sole shoes are the next best thing to bare feet, allowing babies to naturally develop toe and muscular strength. Since walking in bare feet is not always practical, these shoes will consist of the finest materials such as leather, suede and soft fabric resulting in a soft, breathable and washable, as well as attractive shoe that protects the baby's tender feet without compromising freedom of movement and growth. To date, most baby shoes are sized in such a way that they need to be replaced every few months. For example, current baby shoe sizes come in 0-3 months, 3-6 months, 6-9 months, 9-12 months, 12-18 months and 18-24 months. Baby shoes such as the popular Robeez® brand are made out of leather and are sized 0-6 months, 6-12 months, 12-18 months and 18-24 months respectively.

In prior art embodiments, elastic used around the ankle cannot accommodate babies with "chubby" feet. The elastic band is too tight and causes poor circulation for those wider feet. On the other hand, babies with narrow feet have the problem of their shoes slipping off their feet. Another key innovation of the present invention is having the adjustment straps 70 and 76 and infinitely variable attachment means 74, 80 and 84 so that the attachment of the baby shoe 10 around the ankle is just right to accommodate the specific needs of the infant.

The covering flap 90 provides additional comfort and security. The shoe 10 is made for both the left foot and the right foot. In this way, if one foot is slightly larger or smaller than the other, the specific size for that foot can be accommodated through the adjustment mechanisms of the present invention and it is not necessary to buy two separate pairs of shoes of different sizes to accommodate the variation in the infant's feet. Once a shoe is worn, it conforms to the shape of the left to right foot so a label/tag will be placed on the right side of the shoe to identify the right foot. This identifies which shoe is to be worn on the right foot.

The shoe may be constructed of three pieces (top 14, side walls and back wall 62, 64 and 66, and sole 60) of flexible and solid material such as soft breathable leather, suede and fabric that will stretch from the top center of the shoe and be compressed until the desired length is achieved. The thin non-skid sole 60 of the expandable shoes allows the child to feel the ground both indoor and outdoor, allowing a secure grip and promoting natural muscle development for a healthy foot development as well as keeping little feet dry in summer and warm in winter.

While the present invention focuses on an expandable and adjustable baby shoe, the principles of the present invention can also be incorporated into a slipper worn by children over 24 months of age. It will be appreciated that the term "children's slipper" can be substituted for the term "baby shoe" so that all of the unique features of the present invention are also incorporated into an expandable and adjustable children's slipper.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A shoe comprising:

a. a body haying a top section, a pair of oppositely disposed sidewalls which extend to a back wall, and a sole, the top section, sidewalls and back wall attached to the sole, the top section extending from a toe section adjacent a front of the shoe to an interior rim b. the top section having an outer surface layer with a multiplicity of spaced apart transverse openings positioned in a lengthwise direction at locations between the front of the shoe and the interior rim, the multiplicity of transverse openings extending through the outer surface layer;

c. a flexible strap fixedly attached at a location adjacent the toe section and extending in said lengthwise direction along the top section and an instep area and terminating in a fastening member, the fastening member having an upper surface and a lower surface which includes a first mating fastener, the outer surface layer of the top section including a second mating fastener at a location adjacent the interior rim along said lengthwise direction, a pulling force on the flexible strap in said lengthwise direction enabling the first and second mating fasteners, respectively, to be connected at a multiplicity of different locations where the distance from the fastening member to the toe area is modified in said lengthwise direction, the closer the fastening member is located to the toe area the more the top section of the shoe is compressed in said lenghtwise ditrection, wherein, when said first and second mating fasteners are connected, said flexible strap is folded over itself at said interior rim;

d. the top section having first and second extension flaps extending from opposite sides of the top section toward the back wall, respectively, each extension flap terminating in a distal end, each extension flap having an interior surface with a third mating fastener located on the interior surface at a location adjacent the distal end, the back wall having an exterior sidewall having a fourth mating fastener thereon, the third mating fasteners on the first and second extension flaps connectable to the fourth mating fastener on the exterior surface of the back wall at a multiplicity of different locations; and e. a covering flap attached to the sidewalls and the back wall and foldable over the interconnection of the mating fasteners on the first and second elongated extension flaps and the mating fastener on the exterior surface of the back wall.

2. The shoe in accordance with claim 1 wherein the first extension flap further comprises a section made of elastic material and the second extension flap further comprises a section made of elastic material.

3. The shoe in accordance with claim 1 wherein the top section, the sidewalls, the back wall and the sole are made of material selected from the group consisting of leather, suede and fabric.

4. The shoe in accordance with claim 1 wherein the flexible strap is visible through the openings in the outer surface layer of the top section.

5. The shoe in accordance with claim 1 wherein the first fastener on the lower surface of the fastening member and the second fastener the outer surface layer of the top section are mating hook and loop fasteners.

6. The shoe in accordance with claim 1 wherein the third mating fasteners on the first and second extension flaps and the fourth mating fastener on the back wall are mating hook and loop fasteners.

7. The shoe of claim wherein said flexible strap is fixedly attached by being sewn into the shoe.

8. The shoe of claim 1 wherein the multiplicity of spaced apart transverse openings comprise a single row of slits in said top section.

9. The shoe of claim 1 wherein, when said first and second mating fasteners are connected, said flexible strap is folded over itself at said interior rim.

10. A shoe comprising:

a. a body having a top section with an outer surface, a pair of oppositely disposed sidewalls which extend to a back wall, and a sole, the top section, sidewalls and back wall attached to the sole, the top section extending from a toe section to an interior rim;

b. a flexible strap fixedly attached at a location adjacent the toe section and extending in a lengthwise direction between the toe section and an instep area adjacent the interior rim through the top section and terminating in a fastening member having a lower surface which includes a first mating fastener, the outer surface layer of the top section including a second mating fastener fixed thereto at a location along said lengthwise direction, a pulling force on the flexible strap in said lengthwise direction enabling the first and second mating fasteners, respectively, to be connected at a multiplicity of different locations where the distance from the fastening member to the toe section is modified in said lengthwise direction, the closer the fastening member is located to the toe section the more the top section of the shoe is compressed in said lengthwise direction, wherein, when said first and second mating fasteners are connected, said flexible strap is folded over the outer surface; and c. the top section having first and second extension flaps extending from opposite sides of the top section toward the back wall, respectively, each extension flap terminating in a distal end, each extension flap having an interior surface with a third mating fastener located on the interior surface at a location adjacent the distal end, the back wall having an exterior sidewall having a fourth mating fastener thereon, the third mating fasteners on the first and second extension flaps connectable to the fourth mating fastener on the exterior surface of the back wall at a multiplicity of different locations.

11. The shoe in accordance with claim 10 further comprising a covering flap attached to the sidewalls and the back wall and foldable over the interconnection of the third mating fasteners on the first and second extension flaps and the fourth mating fastener on the exterior surface of the back wall.

12. The shoe in accordance with claim 10 further comprising the outer surface layer having a multiplicity of spaced apart transverse openings positioned at locations along the top section from the toe section to the interior rim, the multiplicity of transverse openings extending through the outer surface layer.

13. The shoe in accordance with claim 12 wherein the flexible strap is visible through the openings in the outer surface layer of the top section.

14. The shoe in accordance with claim 10 wherein the first extension flap further comprises a section made of elastic material and the second extension flap further comprises a section made of elastic material.

15. The shoe in accordance with claim 10 wherein the top section, the sidewalls, the back wall and the sole are made of material selected from the group consisting of leather, suede and soft fabric.

16. The shoe in accordance with claim 10 wherein the first fastener on the lower surface of the fastening member and the second fastener on the outer surface layer of the top section are mating hook and loop fasteners.

17. A slipper comprising:

a. a body having a top section, a pair of oppositely disposed sidewalls which extend to a back wall, and a sole, the top section, the sidewalls and back wall attached to the sole, the top section extending from a toe section adjacent a front of the slipper to an interior rim adjacent an instep area of said slipper, said front of the slipper and said interior rim defining a lengthwise direction therebetween;

b. the top section having an outer surface;

c. a flexible strap fixedly attached at a location adjacent the toe section said flexible strap extending in said lengthwise direction through the top section and terminating in a fastening member having a lower surface which includes a first mating fastener, the outer surface layer of the top section including a second mating fastener at a location adjacent the interior rim along side lengthwise direction and in said instep area, a pulling force on the flexible strap in said lengthwise direction enabling the first and second mating fasteners, respectively, to be connected at a multiplicity of different locations where the distance from the fastening member to the toe section is modified in said lengthwise direction, the closer the fastening member is located to the toe section the more the top section of the slipper is compressed sin said lengthwise direction; and d. the top section having first and second extension flaps extending from opposite sides of the top section toward the back wall, respectively, each extension flap terminating in a distal end, each extension flap having an interior surface with a third mating fastener located on the interior surface at a location adjacent the distal end, the back wall having an exterior sidewall having a forth mating fastener thereon, the third mating fasteners on the first and second extension flaps connectable to the fourth mating fastener on the exterior surface of the back wall at a multiplicity of different locations.

18. The slipper in accordance with claim 17 further comprising a covering flap attached to the sidewalk and the back wall and foldable over the interconnection of the third mating fasteners on the first and second extension flaps and the fourth mating fastener on the exterior surface of the back wall.

19. The slipper in accordance with claim 17 further comprising the outer surface layer having a multiplicity of spaced apart transverse openings positioned at locations along the top section from the toe section to the interior rim through which the flexible strap can be threaded.

20. The slipper in accordance with claim 19 wherein the flexible strap is visible through selected openings in the outer surface layer of the top section.

21. The slipper in accordance with claim 17 wherein the first extension flap further comprises a section made of elastic material and the second extension flap further comprises a section made of elastic material.

22. The slipper in accordance with claim 17 wherein the top section, the sidewalls, the back wall and the sole are made of material selected from the group consisting of leather, suede and soft fabric.

23. The slipper in accordance with claim 17 wherein the first fastener on the lower surface of the fastening member and the second fastener on the outer surface layer of the top section are mating hook and loop fasteners.

24. A shoe comprising:

(A) a body having a top section, a pair of oppositely disposed sidewalls which extend to a back wall, and a sole, the top section, sidewalls and back wall attached to the sole, the top section extending from a toe section adjacent a front of the shoe to an interior rim;

(B) the top section having an outer surface layer with a multiplicity of spaced apart transverse openings positioned in a lengthwise direction at locations between the front of the shoe and the interior rim, the multiplicity of transverse openings extending through the outer surface layer and comprising a single row of slits in said top section;

(C) a flexible strap fixedly attached at a location adjacent the toe section and extending in said lengthwise direction along the top section and an instep area and terminating in a fastening member, the fastening member having an upper surface and a lower surface which includes a first mating fastener, the outer surface layer of the top section including a second mating fastener positioned along said lengthwise direction, a pulling force on the flexible strap in said lengthwise direction enabling the first and second mating fasteners, respectively, to he connected at a multiplicity of different locations along, the lengthwise direction where the distance from the fastening member to the toe area is modified in said lengthwise direction, the closer the fastening member is located to the toe area the more the top section of the shoe is compressed in said lengthwise direction, wherein, when said first and second mating fasteners are connected, said flexible strap is folded over itself at said interior rim.

25. The shoe as in claim 24 further comprising:

(D) the top section having first and second extension flaps extending from opposite sides of the top section toward the back wall, respectively, each extension flap terminating in a distal end, each extension flap having an interior surface with a third mating fastener located on the interior surface at a location adjacent the distal end, the back wall having an exterior sidewall having a fourth mating fastener thereon, the third mating fasteners on the first and second extension flaps connectable to the fourth mating fastener on the exterior surface of the back wall at a multiplicity of different locations; and (E) a covering flap attached to the sidewalls and the back wall and foldable over the interconnection of the mating fasteners on the first and second elongated extension flaps and the mating fastener on the exterior surface of the back wall.

* * * * *